US008943938B2

(12) United States Patent
Sahlberg

(10) Patent No.: US 8,943,938 B2
(45) Date of Patent: Feb. 3, 2015

(54) DISPENSER

(75) Inventor: Filip Sahlberg, Göteborg (SE)

(73) Assignee: SCA Hygiene Products AB, Göteborg (SE)

( * ) Notice: Subject to any disclaimer, the term of this patent is extended or adjusted under 35 U.S.C. 154(b) by 202 days.

(21) Appl. No.: 13/808,283

(22) PCT Filed: Jul. 7, 2010

(86) PCT No.: PCT/EP2010/059715
§ 371 (c)(1),
(2), (4) Date: Feb. 5, 2013

(87) PCT Pub. No.: WO2012/003866
PCT Pub. Date: Jan. 12, 2012

(65) Prior Publication Data

US 2013/0192437 A1 Aug. 1, 2013

(51) Int. Cl.
*B26D 1/62* (2006.01)
*B26D 7/00* (2006.01)

(52) U.S. Cl.
USPC ..... 83/295; 83/649; 83/303

(58) Field of Classification Search
USPC ..... 83/648, 649, 650, 295, 303; 225/3, 4, 225/93
See application file for complete search history.

(56) References Cited

U.S. PATENT DOCUMENTS 1,811,537 A 6/1931 Cummings
3,896,691 A * 7/1975 Granger et al. ..... 83/335
4,188,844 A 2/1980 DeLuca
4,621,755 A 11/1986 Granger
4,635,837 A 1/1987 Granger
4,676,131 A * 6/1987 Cassia ..... 83/208
4,712,461 A * 12/1987 Rasmussen ..... 83/334
5,048,386 A 9/1991 DeLuca et al.

(Continued)

FOREIGN PATENT DOCUMENTS

EP 0 219 732 A2 4/1987
EP 0 526 358 A1 2/1993

(Continued)

OTHER PUBLICATIONS

International Search Report (PCT/ISA/210) issued on Apr. 6, 2011, by the European Patent Office as the International Searching Authority for International Application No. PCT/EP2010/059715.

(Continued)

*Primary Examiner* — Sean Michalski
(74) *Attorney, Agent, or Firm* — Buchanan Ingersoll & Rooney PC

(57) ABSTRACT

A dispenser for repeatedly discharging a predetermined length of a continuous web of material, especially paper towels, comprises a feed roller (14) with the continuous web of material wound thereon and a cutting drum (20) incorporating a cutting device (24, 32), the continuous web of material being directed in contact to at least part of the cutting drum (20). The dispenser is characterized in that the cutting device (24, 32) comprises at least two cutting knives (24) with cutting blades (26), which cutting blades (26) are operable between an active, extended position projecting beyond the outer circumferential surface of the cutting drum (20), and an inactive retracted position; wherein each cutting knife (24) is provided with a cam follower (44) engaging a stationary cam path (46) of a camming mechanism (40).

9 Claims, 5 Drawing Sheets

(56) References Cited

U.S. PATENT DOCUMENTS

| | | | | |
|---|---|---|---|---|
| 6,314,850 | B1 * | 11/2001 | Morand | 83/327 |
| 6,474,209 | B1 * | 11/2002 | Granger | 83/649 |
| 7,571,670 | B2 * | 8/2009 | Formon | 83/648 |
| 8,555,761 | B2 * | 10/2013 | Keily et al. | 83/343 |
| 2002/0096028 | A1 * | 7/2002 | Morand | 83/13 |
| 2006/0236832 | A1 * | 10/2006 | Cvjetkovic et al. | 83/337 |
| 2007/0079676 | A1 | 4/2007 | Friesen et al. | |
| 2012/0167734 | A1 * | 7/2012 | Hansen et al. | 83/337 |
| 2013/0192437 | A1 * | 8/2013 | Sahlberg | 83/304 |
| 2014/0116216 | A1 * | 5/2014 | Morand | 83/175 |

FOREIGN PATENT DOCUMENTS

| | | | |
|---|---|---|---|
| FR | 2 340 887 | A2 | 9/1977 |
| FR | 2 531 049 | A1 | 2/1984 |

OTHER PUBLICATIONS

Written Opinion (PCT/ISA/237) issued on Apr. 6, 2011, by the European Patent Office as the International Searching Authority for International Application No. PCT/EP2010/059715.

International Preliminary Report on Patentability (PCT/IPEA/409) issued on Apr. 30, 2012, by the European Patent Office as the International Searching Authority for International Application No. PCT/EP2010/059715.

Office Action (Decision on Grant) issued on Mar. 21, 2014, by the Russia Patent Office in corresponding Russian Patent Application No. 2013104992, and an English Translation of the Office Action (9 pages).

* cited by examiner

DISPENSER

FIELD OF THE INVENTION

The invention relates to a dispenser for repeatedly discharging a predetermined length of a continuous web of material, especially paper towels.

PRIOR ART

A number of dispensing devices are known in the art. Such dispensers serve for dispensing and cutting web material, including paper towelling, paper products and the like. With such dispensers, the processes of dispensing and cutting the web material are carried out automatically by pulling on the free or "tail" end of the web material that extends from the dispenser. The web material is taken from a feed roller and the action of pulling the web material causes the feed roller to rotate. The continuous web taken from the feed roller is directed to a cutting mechanism which is also driven by the pulling operation of the user. Such cutting mechanism cuts the continuous web at predetermined lengths.

In many conventional dispensers, the cutting mechanism uses a cutting drum equipped with a blade which moves from a retracted position within the drum to an extended position once the drum reaches a predetermined rotational position to effect a cutting of the web material.

U.S. Pat. No. 1,811,537 describes a dispenser holding a continuous roll of paper and severing the end of the web into sheets of predetermined lengths which are discharged one at a time. A knife is disposed within a groove extending longitudinally of a cutting drum. Spring means are provided for urging the knife outwards of the groove to severe a predetermined length of the web.

A mechanism for cutting a web of flexible sheet material is known from U.S. Pat. No. 4,188,844. Such mechanism to be used in a dispenser has a feed roller and a pinch roller between which rollers the web passes. A knife is pivotally mounted in the feed roller to swing about an axis. The cutting edge of the knife projects outwardly beyond the periphery of the feed roller to cut the web as it passes over the feed roller. Cam followers are affixed to the knife and run in cam means which are stationarily mounted. The cam means have a cam surface engaged with the cam follower to swing the cam follower along an arcuate path in order to project the cutting edge of the knife upon rotation of the feed roller. A second cam surface engaging the cam follower serves to retract the cutting edge of the knife upon further rotation of the roller.

Another example of a feed mechanism with a cam follower mechanism for operating a cutting knife is known from U.S. Pat. No. 5,048,386 and US 2007/0079676 A1. Such prior art dispensers require a relatively high pulling force which even can lead to the inadvertent tearing of the web in case of a relatively thin paper. This restricts the use of conventional dispensers to a specific type of material to be dispensed.

EP 0 526 358 A1 discloses a dispenser with the pre-characterizing features of claim 1.

SUMMARY

An object underlaying the invention is to provide a dispenser for repeatedly discharging a predetermined length of a continuous web of material which can be used for various types of material to be dispensed as well as different metered lengths of material.

The dispenser for repeatedly discharging a predetermined length of a continuous web of material, especially paper towels, comprises a feed roller with the continuous web of material wound thereon, and a cutting drum incorporating a cutting device, the continuous web of material being directed in contact to at least part of the cutting drum. The dispenser is characterized in that the cutting device comprises at least two cutting knives with cutting blades, which cutting blades are operable between an active, extended position projecting beyond the outer circumferential surface of the cutting drum, and an inactive retracted position, wherein each cutting knife is provided with a cam follower engaging a stationary cam path of a camming mechanism.

The dispenser has a cutting drum with at least two individual cutting knives at different positions of the circumferential direction of the cutting drum. This specific feature has several advantages. Since two or more individual cutting knives are placed along the circumferential direction of the cutting drum, either a shorter sheet length is possible or, when maintaining the same sheet length as is used with a cutting drum with one cutting knife only, it is possible to reduce the pull force required to operate the dispenser. The reduction of pull force is based on the general principle that the momentum effecting a rotation of the cutting drum linearly increases with increasing diameter of the cutting drum. Therefore, a larger cutting drum reduces the necessary pull force and, at the same time, a higher number of cutting knives can be placed along the circumferential direction of the cutting drum so as to provide for a desired sheet length dispensed. In other words, it is possible to select different lengths of paper depending on the number of cutting knives provided on the cutting drum. A further advantage of the dispenser lies in a controlled movement of the cutting device because each knife is provided with a cam follower engaging a stationary cam path of a camming mechanism. Such camming mechanism serves to generate a highly accurate movement of each knife.

Further, the cutting drum incorporating a cutting device has two cutting knives which are positioned diametrically opposite to each other relative to the cutting drum. Such position of two cutting knives generates the same length of each paper towel.

The dispenser, the cutting device of which has two cutting knives, further comprises an elastic means suitable to rotate into and hold the cutting drum in one of two distinct equilibrium positions. This specific feature serves to eject a paper tail for the next user. Once the paper web has been cut, the pulling force of a user can no longer be used to rotate the cutting drum and feed roller. Therefore, an internal means has to be provided in order to further move the cutting drum into a position so that a paper tail of the web to de dispensed can be grasped by the next user. Such further rotation can be best carried out by providing two distinct equilibrium positions of the cutting drum so that, after severing the web, the cutting drum rotates into the next of the two equilibrium positions.

According to a preferred embodiment, the elastic means comprises two spring elements, both of which are attached at one end to a stationary part of the dispenser and at the other end to an attachment point off-axis relative to the longitudinal axis of the cutting drum and movable together with the rotation of the cutting drum. This is a simple means to provide an elastic means with two distinct equilibrium positions. The equilibrium positions are defined by the state in which the sum of the stretching forces of both spring elements are at a minimum. According to nature's law, each system seeks to come into a state of lowest energy so that the cutting drum, after cutting the web, will automatically rotate into the next position which provides a minimum value of the overall energy. Such system using two spring elements can be adjusted such that the rotation of the cutting drum will be in the right direction in order to feed the paper tail for the next user. Further, spring elements have a small friction so that the cutting drum will not become stuck at some undesirable intermediate position because high friction forces cannot be overcome when rotating into the equilibrium state. Further, such system using two spring elements only requires a small number of parts so that such mechanism can be manufactured at low costs and is easy to assemble.

According to a preferred embodiment, the diameter of the cutting drum is from 120 mm to 210 mm, preferably around 140 mm. The advantage of such selection of diameter is a low pull force required because of a higher momentum. The larger diameter also enables a suitable sheet length even when each sheet is only half the circumference, instead of as in earlier such dispensers where one sheet is one full circumference. Further, a low cutting force is possible since, with a cutting drum of a diameter of at least 120 mm, a lot of space is available to operate the cutting knives via long levers. If a diameter of the cutting drum of 210 mm is selected, three cutting knives can be distributed over the perimeter of the cutting drum.

Preferably, the feed roller is positioned such as to abut the cutting drum. Such design reduces the space required inside the dispenser. Such space can be used to increase the diameter of the cutting drum. Further, no separate braking mechanism is necessary because the rotation of the feed roller is stopped by the cutting drum once the cutting drum has been rotated into one of the equilibrium positions.

According to a preferred embodiment, the cutting blade of each cutting knife has two main surfaces and an edge portion, wherein in the inactive, retracted position of the cutting knives, one main surface of each cutting blade essentially follows the outer circumferential surface of the cutting drum. In other words, in the inactive, retracted position of the cutting blades, the slot formed in the cutting drum for holding the cutting knife is essentially closed. As a result of this, there are no gaps in the cutting drum except in those position where the cutting knife is in its active, extended position projecting beyond the outer circumferential surface of the cutting drum. When such position of the cutting knife in the inactive, retracted position is used in combination with a feed roller positioned such as to abut the cutting drum, no bumping effect occurs. This means that the feed roller runs smoothly over the circumferential surface of the cutting drum since one main surface of each cutting blade essentially closes the gap formed in the cutting drum. As a result of this, the noise generated between the feed roller and the cutting drum when operating the dispenser can be reduced.

Preferably, the dispenser is further characterized by two camming mechanisms, one camming mechanism being positioned at each longitudinal end of the cutting drum. The specific advantage of this feature is a good, controlled movement of the knives since, in case of two knives, these can be simultaneously operated from both longitudinal sides of the cutting drum. Further, the controlled movement also contributes to a low pulling force required to operate the dispenser.

According to an alternative embodiment of the invention, each of two cutting knives can be operatively connectable to a different camming mechanism. If such design is used, there is increased flexibility as to which knife follows which of the cam paths. This opens up the possibility to provide alternating sheet lengths or to select long or short sheets depending on the position and design of the two camming mechanisms.

BRIEF DESCRIPTION OF THE DRAWINGS

In the following, embodiments of the invention will be briefly described by way of example with reference to the accompanying drawings in which.

DESCRIPTION OF PREFERRED EMBODIMENTS

Figure 1:
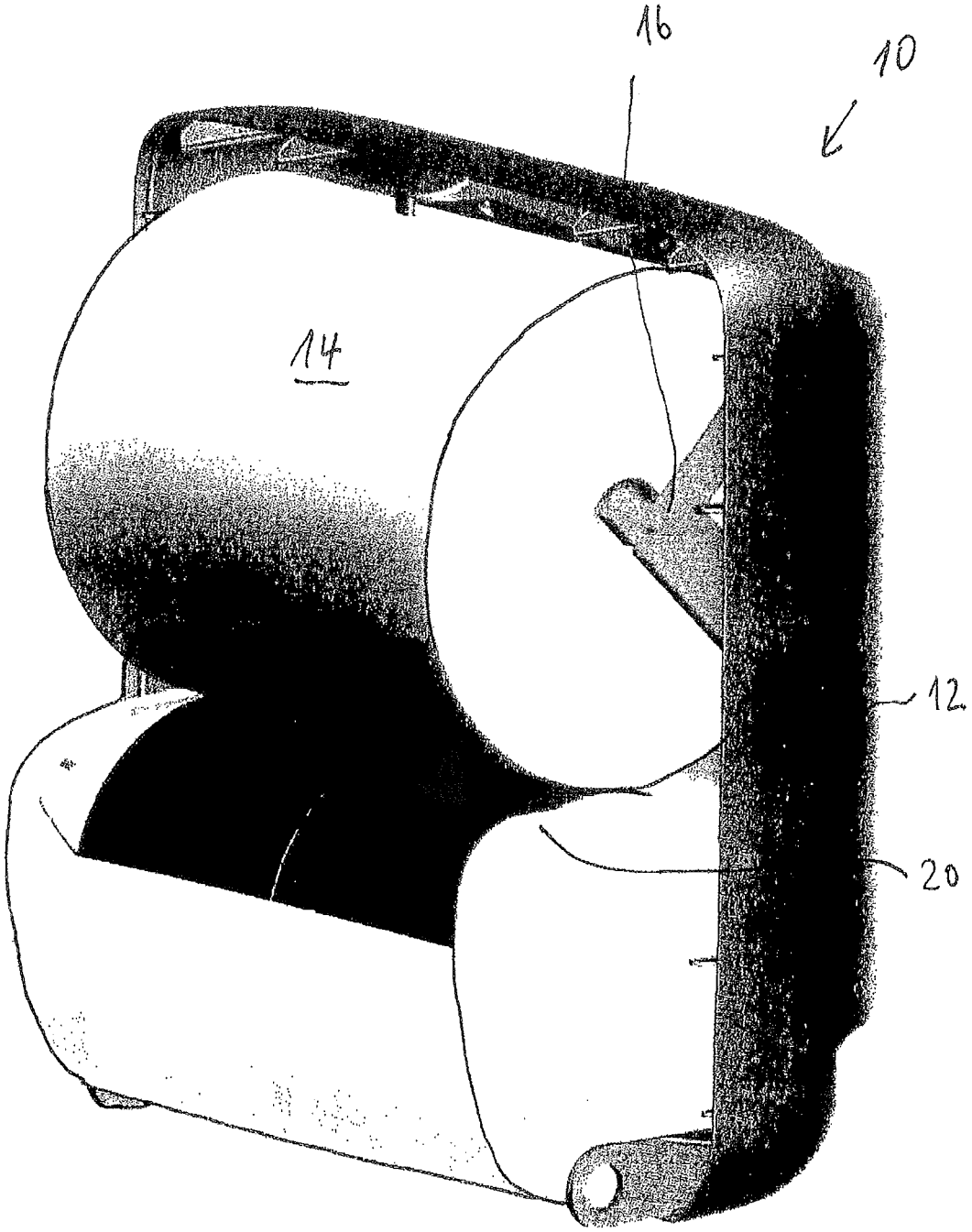
FIG. 1 shows a part of a dispenser and the relative position of a feed roller and a cutting drum.

In the following, throughout the drawings, the same elements will be denoted by the same reference numerals.

Figure 2:
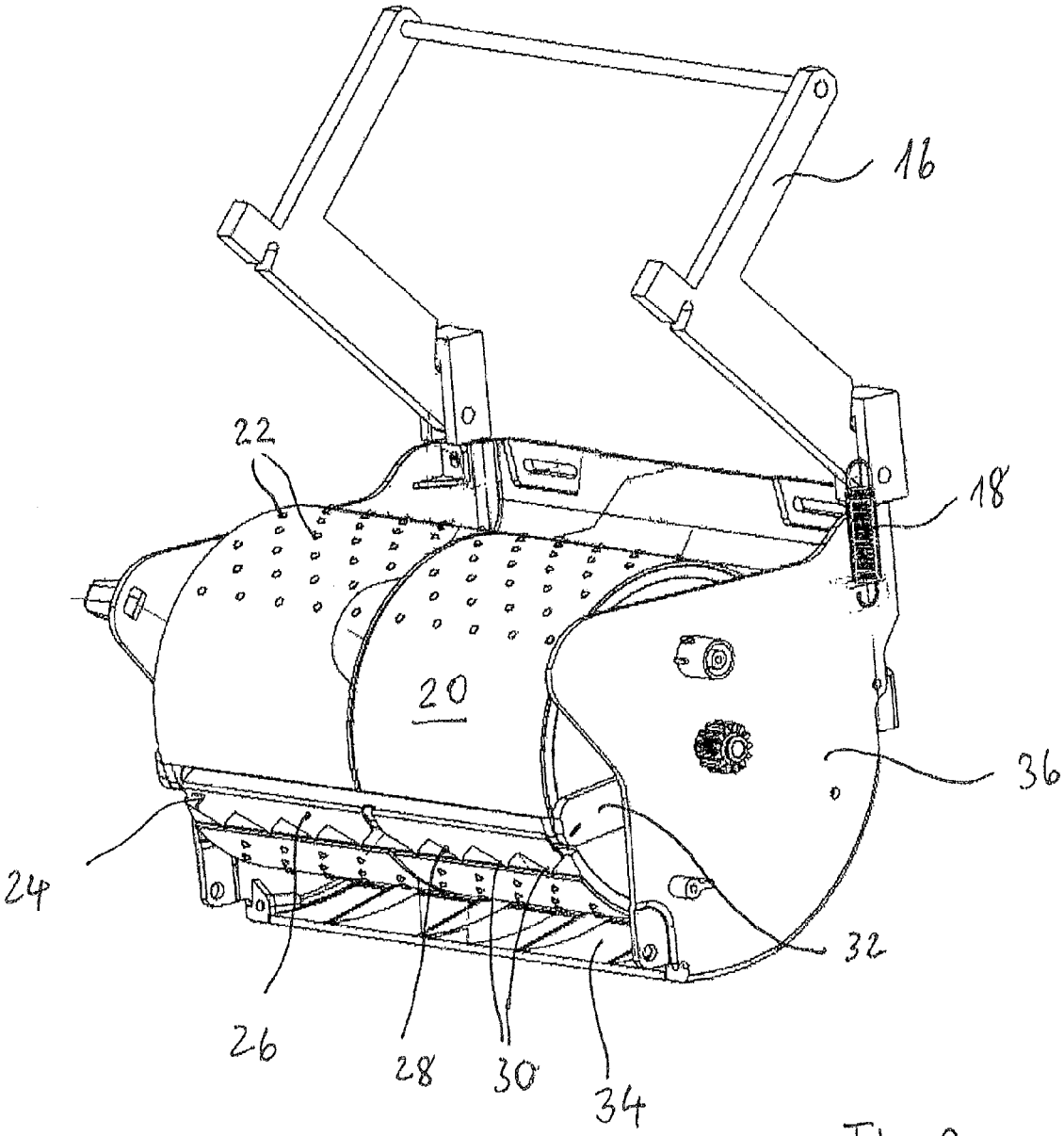
FIG. 2 shows a part of the dispenser and especially its cutting drum.

FIG. 1 shows a part of a dispenser 10 and especially the rear side 12 of its housing which can be affixed e.g. to a wall. The housing 12 is usually made of a hard plastic material. The housing mainly contains a feed roller 14 equipped with a continuous web of e.g. paper with a high absorbency which could be used in public rest rooms. The feed roller 14 is held by a mounting bracket 16 which is pivotally attached to the housing and can be biased by means of springs 18 (as shown in FIG. 2) but also by gravity into such a position that feed roller 14 always abuts against and slightly urges against cutting drum 20 positioned below feed roller 14. The cutting drum 20 has a relatively large diameter from 120 mm to 150 mm and preferably around 140 mm.

In operation, a continuous web is removed from feed roller 14, runs between feed roller 14 and cutting drum 20 and partly around cutting drum 20 in order to leave the dispenser 10 in a position below the cutting drum 20. When a user grasps the web and pulls the tail end of the web, this pulling force generates a rotation of the cutting drum 20 and, correspondingly, of the feed roller 14. Depending on the amount of material wound on the feed roller, the rotational speed of the feed roller 14 and cutting drum 20 differ from each other. However, the circumferential rotational speed of both rollers is the same. During the rotation of the cutting drum, the paper web is cut to a suitable length so that the user receives a metered length of the web material. As will be described later, the dispenser continuous the rotational movement even without the pulling force of a user in order to eject a tail end of the web for being grasped by the next user.

FIG. 2 shows in more detail the cutting drum 20 of the dispenser and its associated parts. The feed roller 14 is not shown in FIG. 2 but the mounting bracket 16 and the biasing spring 18 are shown.

The cutting drum has a cylinder shape. On its circumferential surface, there can be provided numerous projections 22 which are slightly elevated over the circumferential surface of the cutting drum. Such projections 22 serve to reduce the contact area between the material to be dispensed and the cutting drum. Such reduction of the contact surface has the effect that the electrostatic charging of the web to be dispensed and of the dispenser is reduced.

FIG. 2 also shows a cutting knife 24 which is provided with a blade 26 with a cutting edge 28, the cutting edge having several teeth 30. However, the invention is not restricted to such shape of the cutting knife 24 and any other shape is also possible as long as the web material to be cut and dispensed can be properly severed.

As can be seen from FIG. 2, the cutting knife 24 is in such a position that the blade 26 roughly follows the circumferential surface of the cutting drum 20. The cutting knife 24 is attached to a knife lever 32, the function of which will be described in more detail by means of the following drawings.

Paper dispensed from a feed roller runs around the cutting drum 20, turns near the lowermost point of the cutting drum and leaves the dispenser at tray 34 where the user can grasp it and pull the web to be dispensed.

Figure 3:
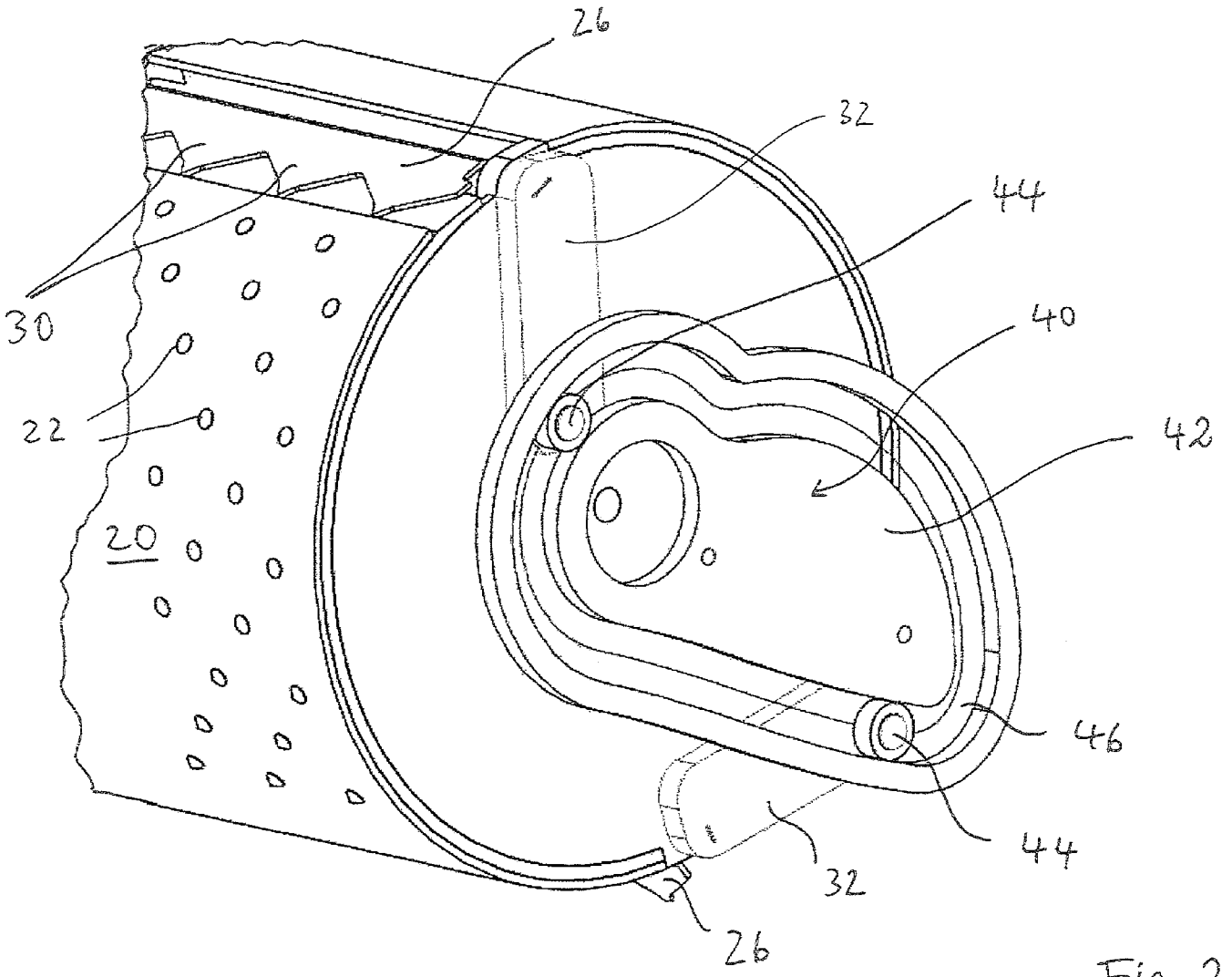
FIG. 3 shows an end surface of a cutting drum with two cutting knives and a camming mechanism.

FIG. 3 shows the longitudinal end of cutting drum 20 in which the side panel 36 as shown in FIG. 2 has been removed. From FIG. 3 it follows that the cutting drum as shown therein is provided with two cutting knives both of which are fixedly attached to a knife lever 32. From FIG. 3 it can be seen that the two cutting knives are arranged on the cutting drum diametrically opposite to each other. This leads to a cutting operation where each sheet to be dispensed has the same length. However, it is also possible to select a different position of the cutting knives relative to each other or to provide more than two cutting knives which is possible by providing different camming mechanisms at both longitudinal sides of the cutting drum and to connect selected cutting knives to either the first or the second camming mechanism.

The camming mechanism 40 is only generally shown in FIG. 3 and will be explained in more detail by means of FIG. 4. The camming mechanism 40 comprises a camming plate 42, the rear side of which is shown in FIG. 3. The opposite side serves as the front side and is provided with a camming slot which is engaged by camming elements fixed to the knife levers, respectively.

Figure 4:
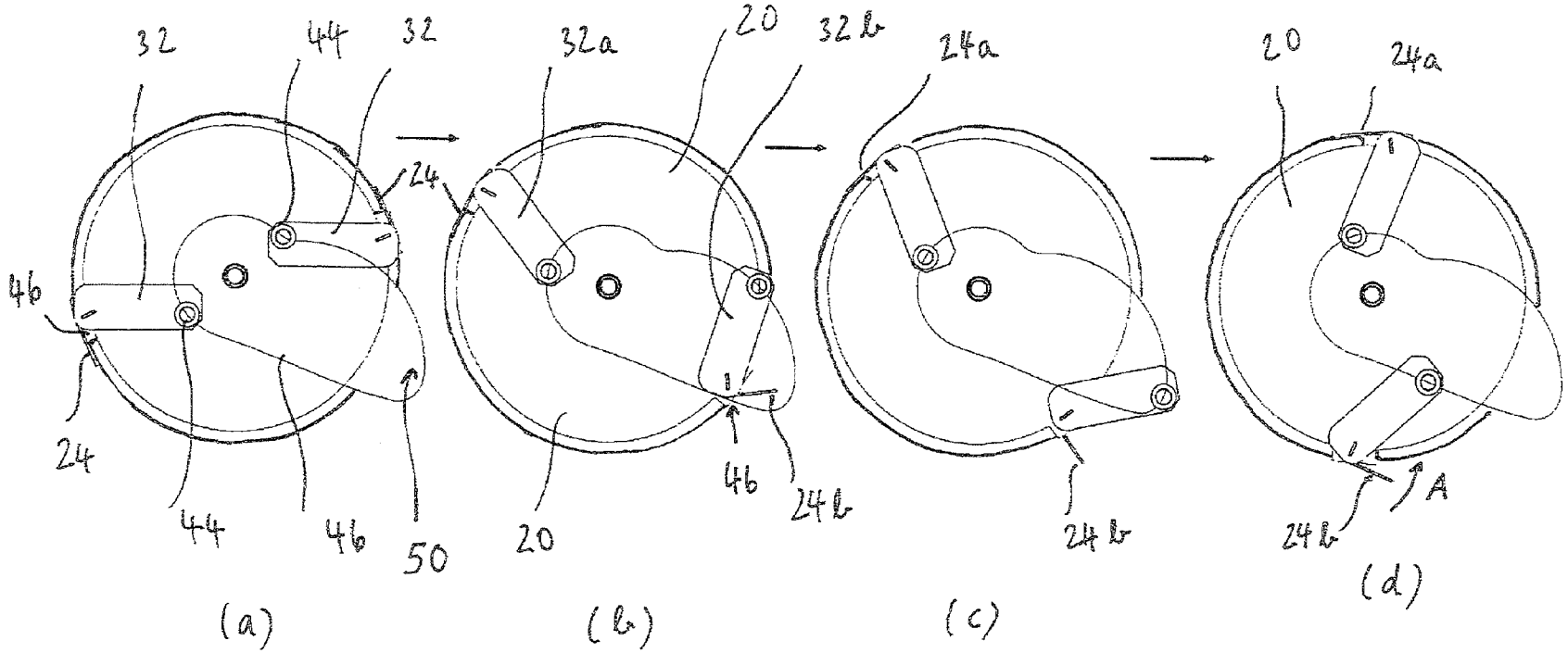
FIG. 4 schematically explains the sequence of the rotational movement of the cutting drum and its related position of two cutting knives.

In order to show the operation of the camming mechanism, FIG. 4 shows a sequence of individual rotational positions of the cutting drum with the position of camming elements 44 at both knife levers 32. The camming element 44 of each knife lever 32 runs along a camming slot 46, which is provided in the front side of camming plate 42 and for which only the center line of the camming slot is shown in FIG. 4. Accordingly, the center line of the camming slot 46 runs through the center of the circular camming elements 44.

The camming plate 42 is at a fixed position relative to the housing of the dispenser so that upon rotation of the cutting drum 20, the knife levers are moved in a predetermined and controlled way because the camming elements fixed to the knife levers 32 are forced along the camming slot 46. In the position as shown in FIG. 4(*a*), both knife levers 32 are in the position as shown in FIG. 3. In this state, each cutting knife is arranged such as to cover the knife slot 45. In this position, one main surface of the blade covers the knife slot 45 so that there are essentially no slots in the outer circumferential surface of cutting drum 20. When the cutting drum is rotated further into position (b) by a clockwise movement in the plane of FIG. 4, the cutting knife 24 fixedly attached to knife lever 32*a* is still in the inactive retracted position, whereas cutting knife 24*b* attached to knife lever 32*b* is on the way into the active, extended position. Cutting knife 24*b* already extends beyond the outer circumferential surface of the cutting drum 20. When a further rotational movement in clockwise direction up to the position in FIG. 4(*c*) has taken place, cutting knife 24*a* is still in the inactive position whereas cutting knife 24*b* is now fully extended and in its cutting position in which the web material is severed. When a further rotational movement is carried out up to the position as shown in FIG. 4(*d*), cutting knife 24*b* has already returned to some extent in direction of arrow A into its retracted position. When a further rotation of the cutting drum 20 is carried out, the situation will resemble again that as shown in FIG. 4(*a*) with the only difference that it is now cutting knife 24*a* which will start in the further progress of rotation to reach the cutting region 50 of the camming slot in which the knife will extend into its active position so as to cut the web of material.

Figure 5:
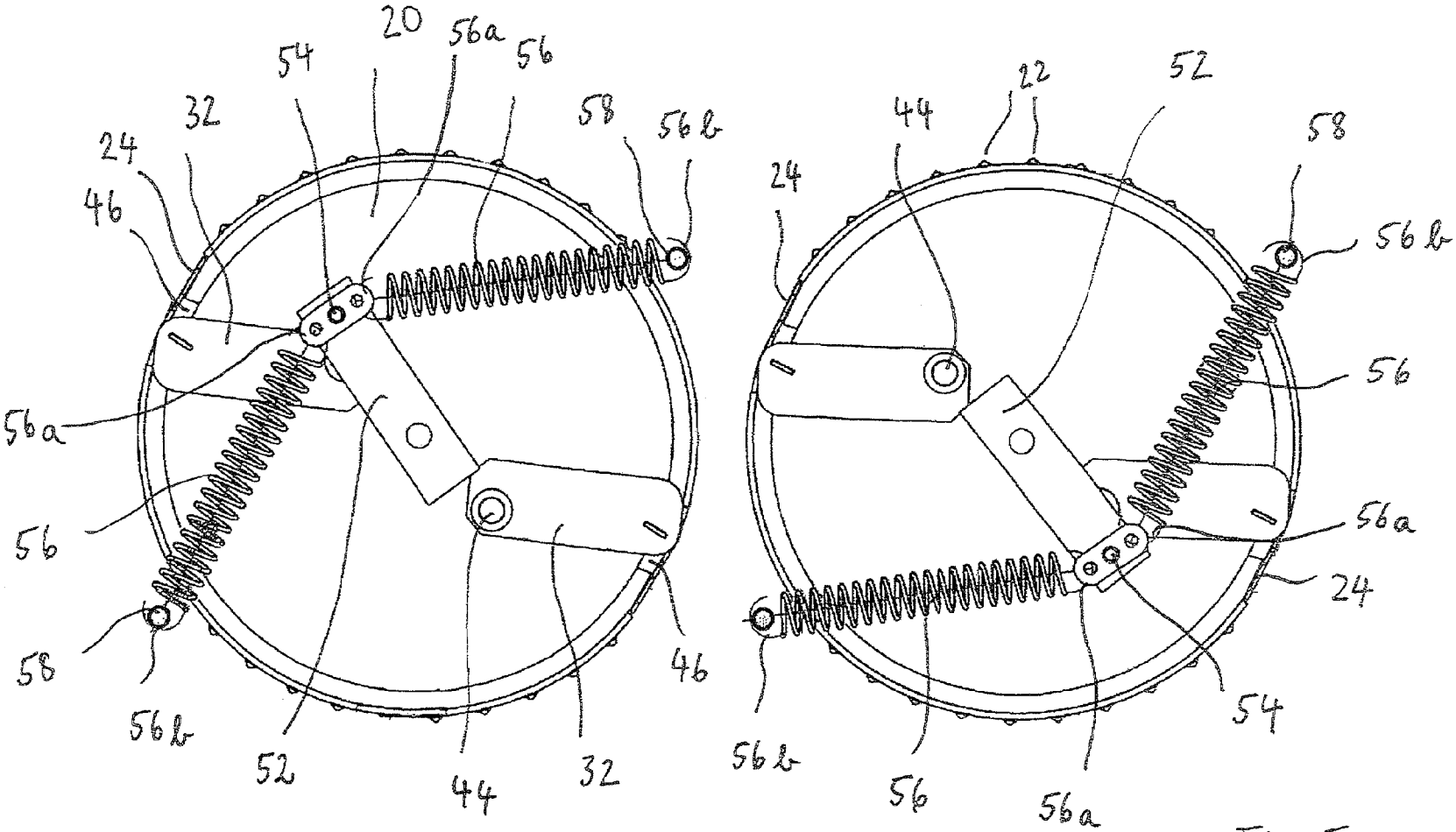
FIG. 5 shows the mechanism for ejecting a paper tail for the next user after cutting the paper web.

Once the web has been cut, the further rotation of the cutting drum can no longer be effected in reaction to the pulling force of a user. Therefore, a mechanism has to be provided so that the cutting drum rotates into a suitable position in which the end of the web to be dispensed is ejected far enough onto the tray so that the next user can grasp and pull again the tail of the web. In order to achieve this function a lever arm 52 is fixed to the cutting drum 20. This lever arm 52 rotates together with the drum. It provides an off-center attachment position 54 which serves to attach the first end 56(*a*) of a spring element 56. When the cutting drum is rotated, the first ends 56*a* of the spring elements 56 change their position. The second ends 56*b* of the spring elements 56 are affixed to a suitable attachment means 58, the position of which is fixed relative to the housing of the dispenser. Therefore, when the cutting drum is rotated, the first ends 56*a* of the spring means change their position together with the lever arm 52, whereas the second ends 56*b* of the spring element 56 remain fixed relative to the dispenser. Therefore, by selecting the geometry two distinct equilibrium states can be achieved which are shown in FIG. 5. In both these equilibrium states, the spring elements 56 have the least tensioning energy so that, provided that the friction of the rotating drum is sufficiently low, the rotating drum 20 will move into the closest of the two equilibrium states as shown in FIG. 5.

The two equilibrium positions as shown in FIG. 5 follow the specific embodiment described with two cutting knives which are diametrically opposite to each other on the cutting drum. However, when using three elastic elements, it is likewise possible to define three distinct equilibrium states. It should be noted that the accuracy of the equilibrium positions need not to be high. It is sufficient that the tail end of the web is further transported to an extent that the next user can comfortably grasp the end of the web. Small positional deviations when reaching the equilibrium state of a few millimeters are not decisive.

The inventive dispenser has the advantage that, due to the large diameter of the cutting drum, the pull force can be kept low. The camming mechanism provides for an accurate and controlled movement of the knives and the further mechanism to further rotate the cutting drum into a near-by equilibrium position makes it possible to eject the paper tail for the next user. The camming mechanism further allows to provide a movement such that, in the inactive, retracted position of the knife, the blades of the knife follow the circumferential surface of the cutting drum. In such a way, no sharp edges are accessible for the user or service personnel in order to minimize the risk of injuries. The larger diameter of the cutting drum also makes it possible to mount the cutting knives to relatively long knife levers. This makes it possible to generate high cutting forces. If, as shown in the specific embodiment, the dispenser roll is in direct contact to the cutting drum, no separate braking mechanism is necessary which reduces the number of components of the dispenser and makes it easier to assemble. The provision of at least two cutting knives makes it possible to realize a shorter length of the individual sheets to be dispensed. If the knives are operated from different sides of the cutting drum, respectively, it is possible to make one knife inoperable. In such a case it is easily possible to select different lengths of paper. Because of the low pulling force required, also relatively thin paper webs can be safely used in the inventive dispenser.

The invention claimed is:

1. A dispenser for repeatedly discharging a predetermined length of a continuous web of material, the dispenser comprising:

a feed roller with the continuous web of material wound thereon;

a cutting drum incorporating a cutting device, the continuous web of material being directed in contact with at least part of the cutting drum;

the cutting device comprises at least two cutting knives with cutting blades, which cutting blades are operable between an active, extended position projecting beyond the outer circumferential surface of the cutting drum, and an inactive, retracted position;

a camming mechanism having a stationary cam path, the camming mechanism attached to the cutting drum;

each cutting knife is provided with a cam follower engaging the stationary cam path of the camming mechanism;

the at least two cutting knives are positioned diametrically opposite to each other relative to the cutting drum; and the dispenser further comprises an elastic element arranged to rotate the cutting drum into one of two distinct equilibrium positions and to hold the cutting drum in the rotated position.

2. The dispenser according to claim 1, wherein the elastic element comprises two spring elements, both of which are attached at one end to a stationary part of the dispenser and at the other end to an attachment point off-axis relative to the longitudinal axis of the cutting drum and movable together with the rotation of the cutting drum.

3. The dispenser according to claim 2, wherein a diameter of the cutting drum is from 120 mm to 210 mm.

4. The dispenser according to claim 2, wherein a diameter of the cutting drum is about 140 mm.

5. The dispenser according to claim 1, wherein the feed roller is positioned so as to abut the cutting drum.

6. The dispenser according to claim 1, wherein the cutting blade of each cutting knife has two main surfaces and an edge portion, wherein in the inactive, retracted position of the cutting blades, one main surface of each cutting blade essentially follows the outer circumferential surface of the cutting drum.

7. The dispenser according to claim 1, further comprising a second camming mechanism having a stationary cam path, one camming mechanism being positioned at each longitudinal end of the cutting drum.

8. The dispenser according to claim 7, wherein each of the two cutting knives is operatively connectable to a different camming mechanism.

9. The dispenser according to claim 1, wherein the continuous web of material is paper towels.

* * * * *